US007878851B2

(12) United States Patent
Silva et al.

(10) Patent No.: US 7,878,851 B2
(45) Date of Patent: Feb. 1, 2011

(54) ELECTRICAL DEVICE AND PLUG FOR AN ELECTRICAL DEVICE

(75) Inventors: Danilo Silva, Gerlingen (DE); Erich Jahrstofer, Forstern (DE); Eric Plantier, Vaihingen/Enz (DE); Jens Gringer, Munich (DE); Peter Weber, Herrsching (DE); Celso Eduardo Fávero, Sao Paulo (BR); Philip De Haan, Germering (DE); Reinhard Dittmann, Feldkirchen (DE)

(73) Assignee: Robert Bosch GmbH, Stuttgart (DE)

( * ) Notice: Subject to any disclaimer, the term of this patent is extended or adjusted under 35 U.S.C. 154(b) by 155 days.

(21) Appl. No.: 12/265,043

(22) Filed: Nov. 5, 2008

(65) Prior Publication Data

US 2009/0123307 A1 May 14, 2009

(30) Foreign Application Priority Data

Nov. 6, 2007 (DE) ..... 10 2007 052 747

(51) Int. Cl.
*H01R 13/40* (2006.01)

(52) U.S. Cl. ..... 439/589; 439/281; 439/934

(58) Field of Classification Search ..... 439/589, 439/281, 934; 310/71
See application file for complete search history.

(56) References Cited

U.S. PATENT DOCUMENTS 3,604,964 A * 9/1971 Conrad et al. ..... 310/71
4,845,393 A * 7/1989 Burgess et al. ..... 310/51
5,141,410 A * 8/1992 Fujii ..... 417/423.7
5,762,481 A * 6/1998 Oi ..... 417/423.3
6,036,456 A * 3/2000 Peters et al. ..... 417/423.3
6,478,613 B1 * 11/2002 Zoell et al. ..... 439/519

FOREIGN PATENT DOCUMENTS

DE 19921539 A1 11/2000

* cited by examiner

*Primary Examiner*—Javaid Nasri
(74) *Attorney, Agent, or Firm*—Ronald E. Greigg

(57) ABSTRACT

Known pumping devices have a connection lid, a connection cap slipped over the connection lid, a hollow chamber formed between the connection lid and the connection cap, and electrical connections that extend through the connection cap into the hollow chamber. It is disadvantageous that when fuels containing water are being pumped, such as ethanol, corrosion can occur at the electrical connections and at the uninsulated cable segments that are exposed to fuel near the electrical connections, for instance at the electrical coils or flexible cables of the carbon brushes, and in the final analysis this leads to an interruption in the electrical contact and thus to failure of the pumping device. In the electrical device of the invention, corrosion of the electrical connections and of the electrical components adjoining them upstream and downstream is avoided entirely or at least greatly diminished. According to the invention, the electrical connections are each provided in separate chambers of the hollow chamber.

12 Claims, 5 Drawing Sheets

ELECTRICAL DEVICE AND PLUG FOR AN ELECTRICAL DEVICE

CROSS-REFERENCE TO RELATED APPLICATIONS

This application is based on German Patent Application No. 10 2007 052 747.2 filed on Nov. 6, 2007, upon which priority is claimed.

BACKGROUND OF THE INVENTION

1. Field of the Invention

The invention is based on an electrical device and a plug for an electrical device.

2. Description of the Prior Art

A pumping device is already known from U.S. Pat. No. 5,762,481, having a connection lid, a connection cap slipped over the connection lid, a hollow chamber formed between the connection lid and the connection cap, and electrical connections that extend through the connection cap into the hollow chamber. It is disadvantageous that when fuels containing water, such as ethanol, are being pumped, corrosion can occur at the electrical connections and at the uninsulated cable segments that are exposed to fuel near the electrical connections, for instance at the electrical coils or flexible cables of the carbon brushes, and in the final analysis this leads to an interruption in the electrical contact and thus to failure of the pumping device.

From German Patent Disclosure DE 199 21 539 A1, a plug for pumping devices comprising contact pins and electrical components is known, parts of which are extrusion-coated with plastic to avoid corrosion. The electrical components are for instance coils, flexible cables, a capacitor, and a ground contact. It is disadvantageous that this version is comparatively expensive to manufacture. Moreover, corrosion continues to occur at the flexible cables.

OBJECT AND SUMMARY OF THE INVENTION

The electrical device according to the invention has the advantage over the prior art that the corrosion of the electrical connections and of the electrical components adjoining them upstream and downstream is avoided entirely or at least greatly diminished, because the electrical connections and the associated electrical components are each provided in chambers, separate from one another, of the hollow chamber.

In one advantageous embodiment, between the electrical connections, at least one partition forming a chamber is disposed.

It is especially advantageous if the partition is embodied on the connection lid and/or on the connection cap, since the division of the hollow chamber into separate chambers can be attained very simply in this way.

It is also advantageous if the partition extends from a bottom of the connection cap to a bottom of the connection lid and/or from a bottom of the connection lid to a bottom of the connection cap, since the division of the hollow chamber into separate chambers can be attained very simply in this way.

It is very advantageous if a seal for sealing off the at least one partition is provided on the bottom of the connection lid and/or on the bottom of the connection cap, since in this way, a very simple, economical sealing of the separate chambers is achieved. In an advantageous embodiment, the seal together with the partition form a gap seal.

It is also advantageous if electrical components are provided in each of the two separate chambers, since these are likewise protected against corrosion by the partition or partitions according to the invention. For example, the electrical components are electrical coils, flexible cables, and/or carbon brushes.

It is further advantageous if the connection cap, on the outside facing away from the hollow chamber, has a plug receptacle for a connection plug, into which the electrical connections protrude, and the plug receptacle has two through openings, discharging into the hollow chamber, for the electrical connections, and between the two through openings, a sealing groove cooperating with the connection plug is provided. In this way, the electrical connections of the electrical device are protected against corrosion outside the hollow chamber as well, as are the plug connections of the connection plug.

The electric plug according to the invention has the advantage over the prior art that corrosion of electrical or electrically conductive components on the plug and on the electrical device is avoided entirely or at least greatly diminished, because the plug wall protrudes in the insertion direction and/or laterally.

It is especially advantageous if the plug connections are embodied in tonglike fashion, since in this way, strong connection forces are achieved along with a very good electrical contact that makes very high current consumption possible. Moreover, this embodiment requires only very little space.

BRIEF DESCRIPTION OF THE DRAWINGS

The invention will be better understood and farther objects and advantages thereof will become more apparent from the ensuing detailed description of a preferred embodiment taken in conjunction with the drawings, in which.

DESCRIPTION OF THE PREFERRED EMBODIMENT

Figure 1:
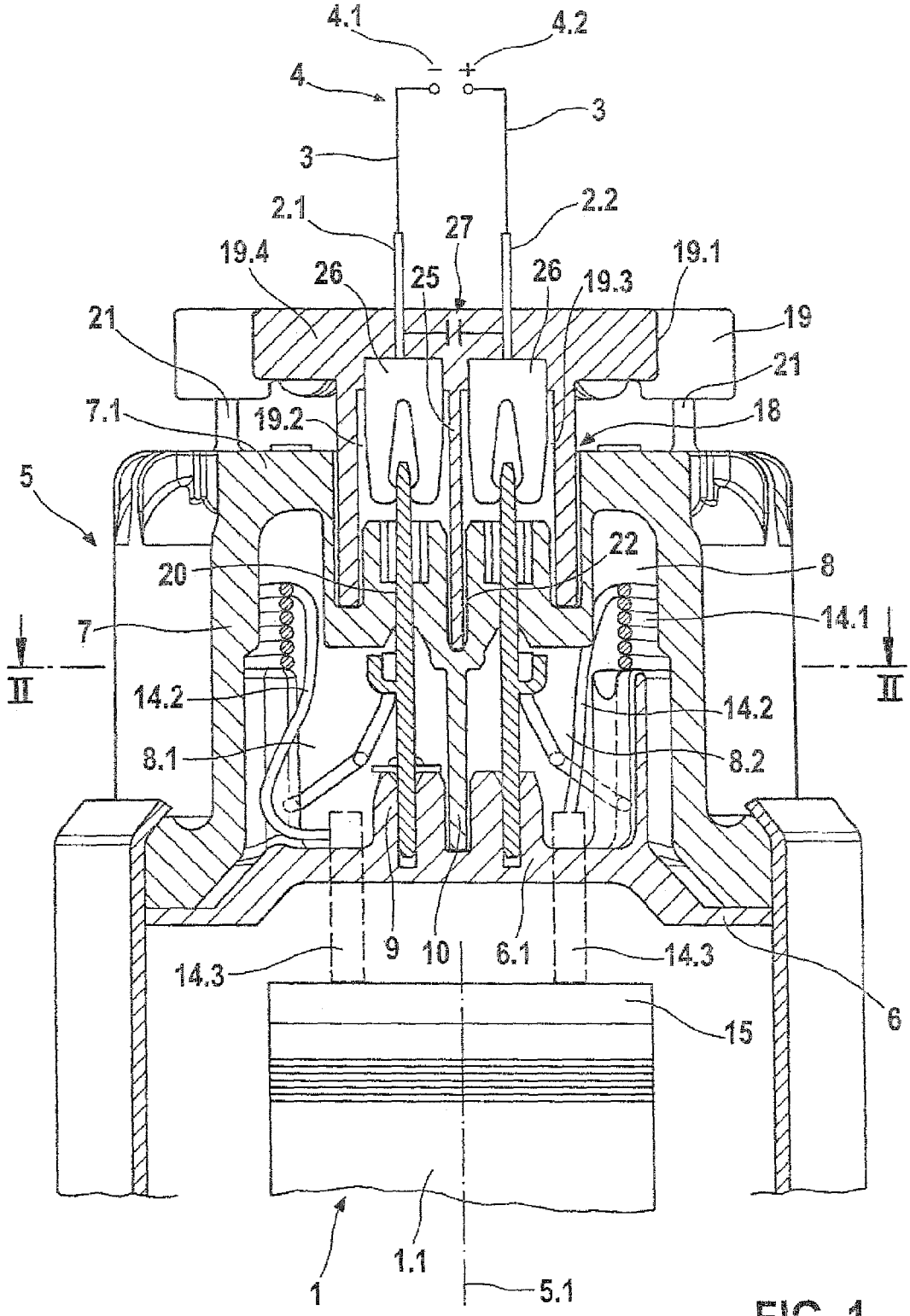
FIG. 1 shows a pumping device of the invention in section.

FIG. 1 shows an electrical device according to the invention in section, taking a pumping device as an example.

The electrical device according to the invention has an electrical consumer 1, such as an electric motor 1.1, which is connected to a voltage source 4 via electrical connections 2 and electrical connection cables 3 adjoining them. In the exemplary embodiment, two electrical connections 2.1, 2.2 are provided, of which one is connected to a negative pole 4.1 and the other to a positive pole 4.2 of the voltage source 4. As an example, the electrical connections 2 are embodied in the form of plug tugs, pins, or prongs and are intended for contacting to a connection plug.

The electrical device has a housing 5 with a connection lid 6 and a connection cap 7 slipped over the connection lid 6. Between the connection lid 6 and the connection cap 7, a hollow chamber 8 is formed. The electrical connections 2 extend through the connection cap 7 into the hollow chamber 8. In the exemplary embodiment, the housing 5 is embodied hollow-cylindrically, and the connection lid 6 closes the housing 5 on its face end. The electrical connections 2.1, 2.2 are retained for instance in a receptacle 9 of the connection lid 6.

The electrical connections 2 of the electrical device and optionally the uninsulated cable portions upstream and downstream of the electrical connections 2 are exposed to a liquid that contains water, for instance as a result of the fact that the electrical device is operated in the liquid. The hollow chamber 8 of the electrical device is not sealed off from the liquid, and thus the electrical connections 2 are exposed to the liquid not only outside the electrical device but also inside the hollow chamber 8. In the prior art, the electrical connections 2, and possibly the uninsulated cable portions upstream and downstream of the electrical connections 2, corrode as a result of electrolytic processes, so that after a certain length of time in operation, failure of the electrical device occurs.

According to the invention, for avoiding corrosion, it is provided that the electrical connections 2 are disposed in the region of the hollow chamber 8, each in separate chambers 8.1, 8.2 of the hollow chamber 8. The electrical connection 2.1 connected to the negative pole 4.1 is disposed in one separate chamber 8.1, and the electrical connection 2.2 connected to the positive pole 4.2 is disposed in the other separate chamber 8.2. If there are further electrical connections 2 besides these, then each should be provided in its own chamber as well.

By the embodiment according to the invention, the electrical connection 2.1 connected to the negative pole 4.1 is separated in the region of the hollow chamber 8 from the electrical connection 2.2 connected to the positive pole 4.2, so that electrolytic processes between the two electrical connections 2 of different polarity in the region of the hollow chamber 8 are suppressed or at least greatly hindered. As a result, no corrosion or only very slight corrosion occurs at the electrical connections 2 and at the uninsulated cable portions upstream and downstream of the electrical connections 2, for instance at the electrical coils, flexible cables and soldered connections.

For forming the separate chambers 8.1, 8.2, at least one partition 10 is provided, which is embodied on the connection lid 6 and/or on the connection cap 7. One of the partitions 10 is disposed between the electrical connections 2.1, 2.2 and their receptacles 9 and, from the circumference of the connection cap 7, it extends radially inward relative to a longitudinal axis 5.1 of the housing 5. The at least one partition 10 may extend in the axial direction relative to the longitudinal axis 5.1, for instance from a bottom 7.1 of the connection cap 7 to a bottom 6.1 of the connection lid 6, or from the bottom 6.1 of the connection lid 6 to the bottom 7.1 of the connection cap 7.

Figure 2:
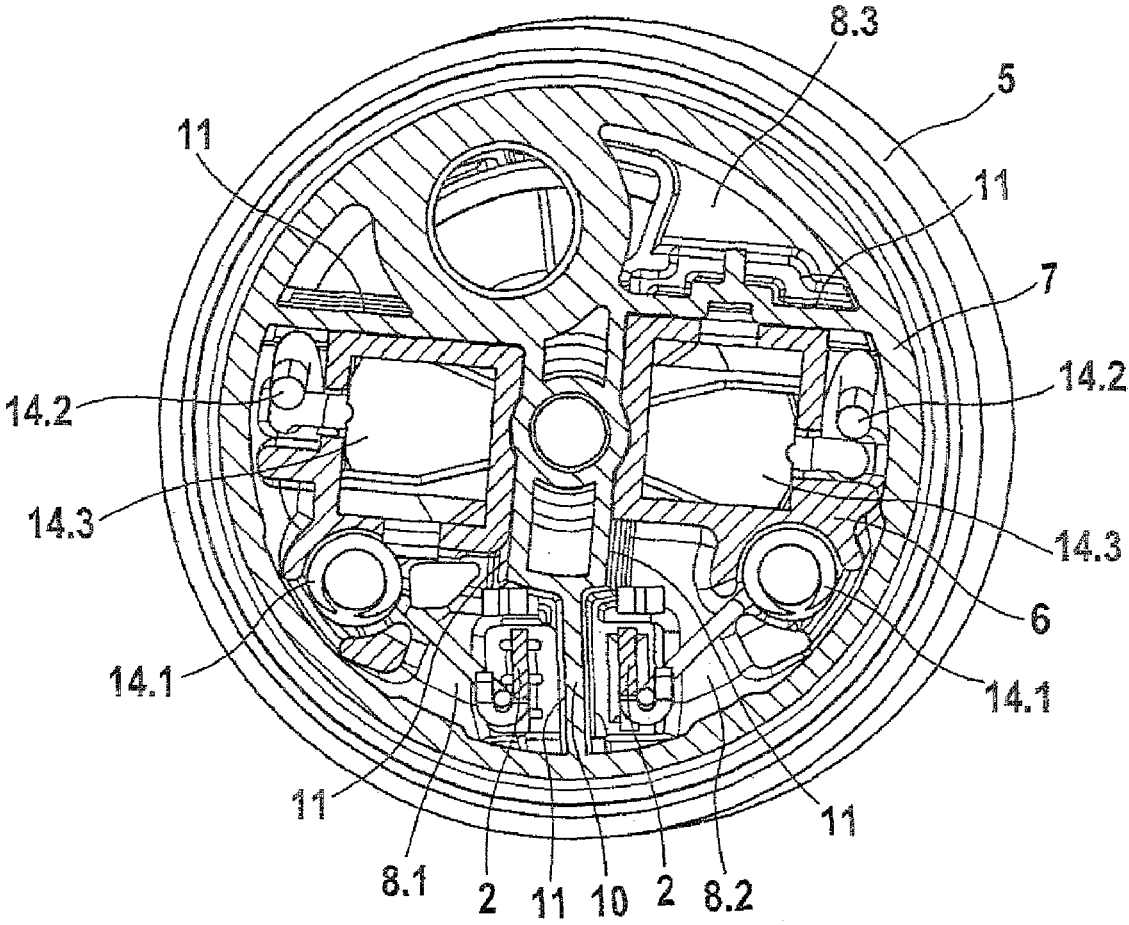
FIG. 2 is a sectional view of the pumping device along the line II-II in FIG. 1.
Figure 3:
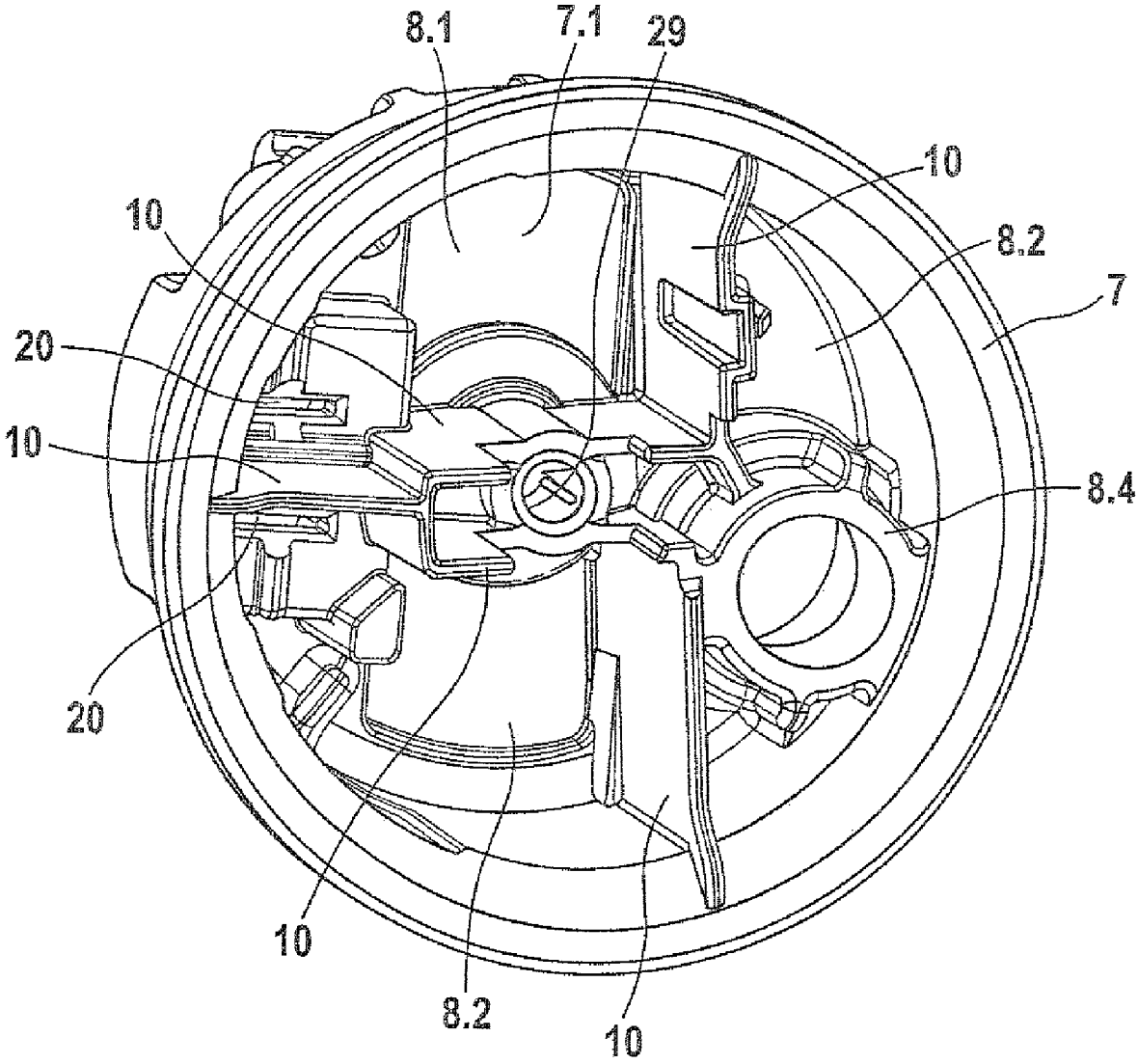
FIG. 3 is a three-dimensional view of the connection cap of FIG. 1.
Figure 4:
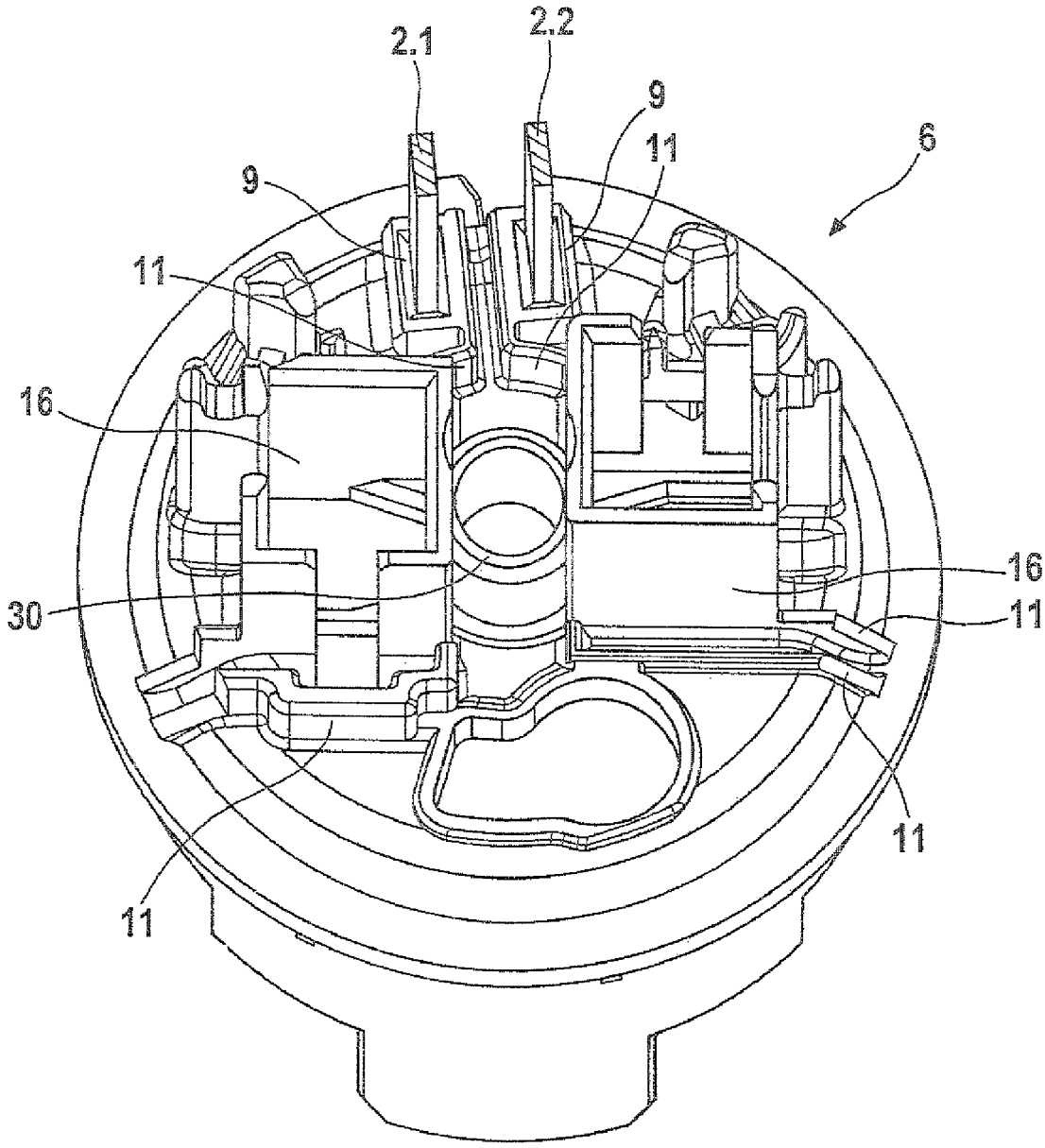
FIG. 4 is a three-dimensional view of the connection lid of FIG. 1.
Figure 5:
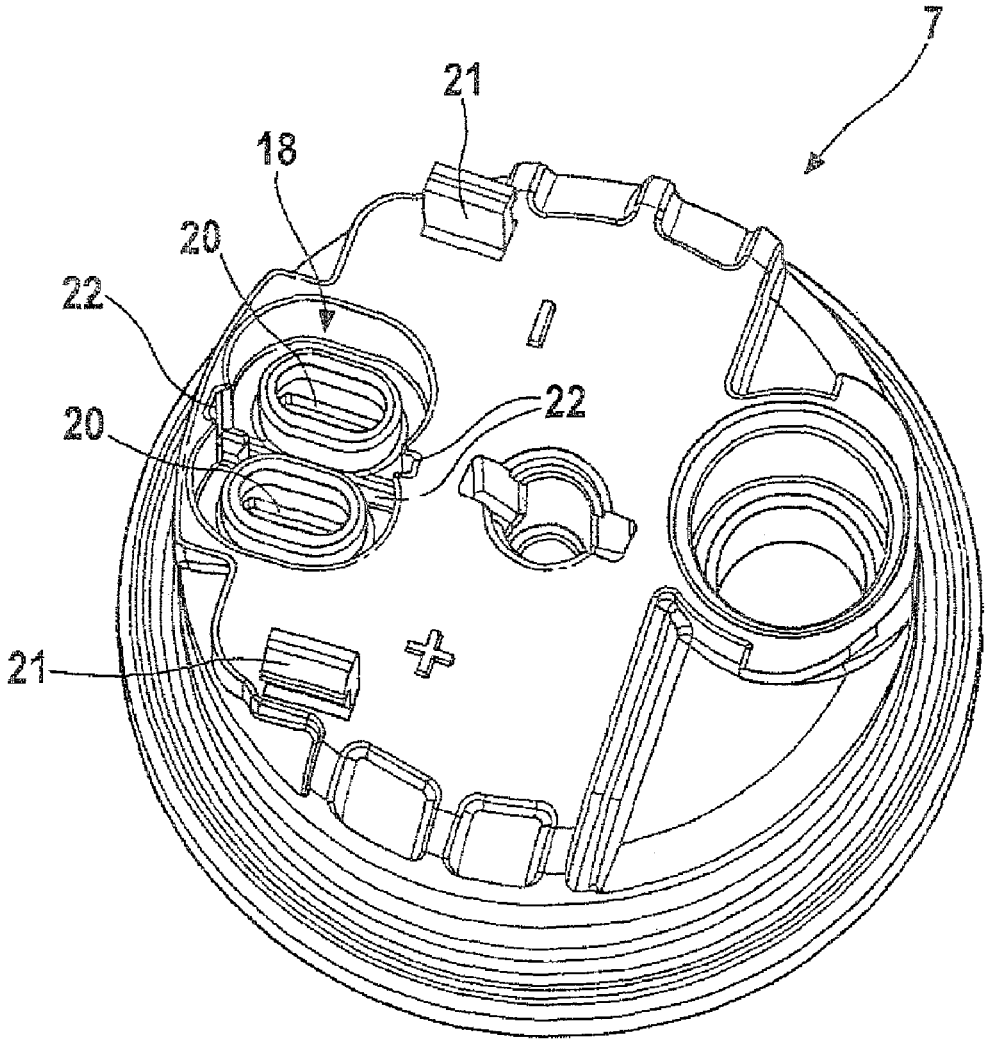
FIG. 5 is a further three-dimensional view of the connection cap of FIG. 1.

The partition 10 is embodied as T-shaped, or together the partitions 10 form a T shape. In this way, the hollow chamber 8 is subdivided into three chambers 8.1, 8.2, 8.3. A hydraulic contact 8.4, for example, extends through the chamber 8.3, as shown in FIGS. 2 and 3.

Sealing means 11 for sealing the at least one partition 10 may be provided on the bottom 6.1, 7.1 diametrically opposite the partition 10. In the exemplary embodiment, the sealing means 11 and the partition 10 together form a gap or labyrinth seal. The sealing means 11 may be one or more indentations, grooves, conduits, protruding walls, or ribs. It is also possible to embody one partition 10 on the connection lid 6 and one partition 10 on the connection cap 7, with the partitions overlapping to form a gap or labyrinth seal. The sealing means 11 are provided along the partition 10 and extend in the same direction as the partition 10.

In the two separate chambers 8.1, 8.2, respective electrical components 14 may be provided, for instance for suppressing electromagnetic interference. The electrical components 14 are for instance electrical coils 14.1, flexible cables 14.2 connected to the electrical coils 14.1, and carbon brushes 14.3 connected to the flexible cables 14.2, for contacting a commutator 15 of the electric motor. The carbon brushes 14.3 are for instance each provided in one guide 16 of the connection lid 6 and are prestressed against the commutator 15 by means of a spring.

The connection cap 7, on the outside facing away from the hollow chamber 8, has a plug receptacle 18 for a connection plug 19. The electrical connections 2 protrude from the hollow chamber 8 through openings 20 into the plug receptacle 18. The plug receptacle 18 is for instance embodied as an indentation or a recess. Retaining means 21 for retaining the connection plug 19 in the plug receptacle 18 are also provided on the connection cap 7. In the exemplary embodiment, the plug receptacle 18 has a sealing groove 22 between the two through openings 20 that cooperates with the connection plug 19.

The connection plug 19 according to the invention has a plug housing 19.1, which has separate plug chambers 19.2, 19.3 that are each separated from one another by a plug wall 25, and in which plug connections 26 connected to connection cables 3 are provided. The electric plug connections 26 cooperate with the electrical connections 2 of the electrical device in contacting fashion. In the embodiment, the electric plug connections 26 are embodied in tonglike fashion. The tonglike shape of the plug connections 26 makes especially high pressing forces possible between the electrical connections 2 and the plug connections 26, so that an especially good electrical contact with the electrical connections 2 is achieved. This version is also especially small.

According to the invention, it is provided that the plug wall 25 protrudes in the insertion direction and/or laterally from the rest of the plug housing 19.1 (FIG. 1). The lateral protrusion is referred to the direction perpendicular to the plane of the drawing. By the embodiment according to the invention of the connection plug 19, when the connection plug 19 is plugged into the plug receptacle 18, a gap or labyrinth seal is formed by the cooperation with the sealing groove 22. The plug wall 25 that protrudes according to the invention protrudes into the sealing groove 22 once the connection plug 19 has been installed. The plug wall 25 is embodied for instance in riblike or strutlike form.

Between the plug connections 26 or between the connection cables 3 near the plug connections 26 is an interference suppression capacitor 27, for instance, for suppressing electromagnetic interference. The interference suppression capacitor 27 and some of the plug connections 26 are extrusion-coated with plastic.

In the exemplary embodiment, the chambers 8.1, 8.2 are bounded by the partitions 10 and the circumference of the connection cap 7. The chambers 8.1, 8.2, 8.3 are embodied in the shape of segments of a circle, for instance.

In the case of a pumping device, the connection cap 7 can have a through opening 29 which discharges into the hollow chamber 8 and in which a pressure limiting valve, not shown, can be inserted that opens beyond a predetermined pressure in the pumping device and allows liquid to flow out.

In the exemplary embodiment, the sealing means 11 are embodied in riblike fashion. For instance, at least intermittently, two spaced-apart ribs are provided, extending parallel to the partition 10; the partition 10 extends into the interstice between the two ribs 11.

As an example, the connection lid 6 has a rotary bearing 30 for the armature of the electric motor 1.1.

The indented plug receptacle 18 has a sealing groove 22, extending in the shape of a U, into which the protruding plug wall 25 of the connection plug 19 extends.

The electrical device is for example an electric pumping device, through which fuel, such as ethanol, that contains water flows, and it is disposed in a fuel tank. However, the electrical device can expressly be any arbitrary other electrical device as well.

The foregoing relates to a preferred exemplary embodiment of the invention, it being understood that other variants and embodiments thereof are possible within the spirit and scope of the invention, the latter being defined by the appended claims.

We claim:

1. An electrical device, comprising:

a connection lid;

a connection cap slipped over the connection lid;

a hollow chamber formed between the connection lid and the connection cap; and electrical connections, extending through the connection cap into the hollow chamber, wherein the electrical connections are each provided in chambers which are separate from one another defined within the hollow chamber.

2. The electrical device as defined by claim 1, further comprising at least one partition disposed between the electrical connections, forming the chambers for the electrical connections.

3. The electrical device as defined by claim 2, wherein the partition is embodied on the connection lid and/or on the connection cap.

4. The electrical device as defined by claim 3, wherein the partition extends from a bottom of the connection cap to a bottom of the connection lid and/or from a bottom of the connection lid to a bottom of the connection cap.

5. The electrical device as defined by claim 4, further comprising sealing means for sealing off the at least one partition are provided on the bottom of the connection lid and/or on the bottom of the connection cap.

6. The electrical device as defined by claim 5, wherein the sealing means together with the partition form a gap seal.

7. The electrical device as defined by claim 1, further comprising electrical components provided in each of the separate chambers.

8. The electrical device as defined by claim 7, wherein the electrical components are embodied as electrical coils connected to the electrical connections, flexible cables connected to the electrical coils, and carbon brushes connected to the flexible cables, for contacting a commutator.

9. The electrical device as defined by claim 1, wherein the connection cap, on its outside facing away from the hollow chamber, has a plug receptacle for a connection plug, into which the electrical connections protrude.

10. The electrical device as defined by claim 9, wherein the plug receptacle has two through openings, discharging into the hollow chamber, for the electrical connections, and between the two through openings, a sealing groove cooperating with the connection plug is provided.

11. A plug for an electrical device as defined by claim 1, further comprising a plug housing, having plug chambers separate from one another, the plug chambers being separated from another by a plug wall and in which plug connections connected to connection cables are provided, wherein the plug wall protrudes in an insertion direction and/or laterally.

12. The plug as defined by claim 11, wherein the plug connections are embodied in tonglike fashion.

* * * * *